US008405598B2

(12) United States Patent
Sumi

(10) Patent No.: US 8,405,598 B2
(45) Date of Patent: Mar. 26, 2013

(54) METHOD FOR OVERDRIVING A LIQUID CRYSTAL DISPLAY TO ENHANCE RESPONSE SPEED AT FREEZING LOW TEMPERATURES

(75) Inventor: Naoki Sumi, Hyogo (JP)

(73) Assignee: Chimei Innolux Corporation, Chu-Nan (TW)

( * ) Notice: Subject to any disclaimer, the term of this patent is extended or adjusted under 35 U.S.C. 154(b) by 905 days.

(21) Appl. No.: 12/428,227

(22) Filed: Apr. 22, 2009

(65) Prior Publication Data

US 2009/0267930 A1 Oct. 29, 2009

(30) Foreign Application Priority Data

Apr. 22, 2008 (JP) ..... 2008-111730

(51) Int. Cl.
*G09G 3/36* (2006.01)

(52) U.S. Cl. ..... 345/101; 345/89

(58) Field of Classification Search ..... 345/87–104
See application file for complete search history.

(56) References Cited

U.S. PATENT DOCUMENTS

| | | | | |
|---|---|---|---|---|
| 7,382,349 | B1 * | 6/2008 | Kuhns | 345/102 |
| 2001/0024199 | A1 * | 9/2001 | Hughes et al. | 345/204 |
| 2002/0044151 | A1 * | 4/2002 | Ijima et al. | 345/601 |
| 2004/0095307 | A1 * | 5/2004 | Kim | 345/96 |
| 2004/0125064 | A1 * | 7/2004 | Adachi et al. | 345/89 |
| 2005/0162359 | A1 * | 7/2005 | Sugino | 345/89 |
| 2006/0071927 | A1 * | 4/2006 | Chang et al. | 345/211 |
| 2007/0046597 | A1 * | 3/2007 | Park et al. | 345/87 |
| 2007/0279407 | A1 * | 12/2007 | Vasquez et al. | 345/213 |
| 2008/0002912 | A1 | 1/2008 | Chen et al. | |
| 2008/0198113 | A1 * | 8/2008 | Cheng et al. | 345/88 |
| 2008/0259059 | A1 * | 10/2008 | De Greef | 345/204 |
| 2008/0284704 | A1 * | 11/2008 | Song et al. | 345/94 |

FOREIGN PATENT DOCUMENTS

| | | |
|---|---|---|
| JP | 2005-107531 | 4/2005 |
| JP | 2006-267653 | 10/2006 |
| JP | 2008-003301 | 1/2008 |

* cited by examiner

*Primary Examiner* — Chanh Nguyen
*Assistant Examiner* — Navin Lingaraju
(74) *Attorney, Agent, or Firm* — Liu & Liu

(57) ABSTRACT

In an overdrive method, target level values of an entire frame are inputted and retained in a first frame memory. According to a combination of a target level value and a currently predicted level value, an overdrive value is obtained from a first data table and an expected predicted level value after a predetermined number of frames varying with temperature is obtained from a second data table, both tables being established depending on temperature. The expected predicted level values of an entire frame are retained in a second frame memory. The same target level value is repetitively provided for the first and the second data tables, and the same expected predicted level value is repetitively provided for the first and the second data tables as the currently predicted level value. According to the overdrive value, a driving voltage is applied to the LCD element.

6 Claims, 8 Drawing Sheets

| Frame time | Frame counter | d'n-1 (Start) | dn (End) | Thermal sensor | dod (OD) | dn' (Predicted) |
|---|---|---|---|---|---|---|
| 0 | 0 | 0 | 100 | -30 | 255 | 46 |
| 1 | 1 | 0 | 100 | -30 | 255 | 46 |
| 2 | 2 | 0 | 100 | -30 | 255 | 46 |
| 3 | 0 | 46 | 100 | -30 | 255 | 81 |
| 4 | 1 | 46 | 100 | -30 | 255 | 81 |
| 5 | 2 | 46 | 100 | -30 | 255 | 81 |
| 6 | 0 | 81 | 100 | -30 | 168 | 100 |
| 7 | 1 | 81 | 100 | -30 | 168 | 100 |
| 8 | 2 | 81 | 100 | -30 | 168 | 100 |
| 9 | 0 | 100 | 100 | -30 | 100 | 100 |
| 10 | 1 | 100 | 100 | -30 | 100 | 100 |
| 11 | 2 | 100 | 100 | -30 | 100 | 100 |

Target = 100 (fixed)
Temperature = -30°C (fixed)

METHOD FOR OVERDRIVING A LIQUID CRYSTAL DISPLAY TO ENHANCE RESPONSE SPEED AT FREEZING LOW TEMPERATURES

FIELD OF THE INVENTION

The present invention relates to an overdrive method for enhancing the response speed of a liquid crystal display (LCD). The present invention also relates to an LCD adapted to be used at a freezing low-temperature by way of overdrive.

BACKGROUND OF THE INVENTION

In an LCD, various voltage signals are applied to LCD elements to change states of liquid crystal so as to change transmittance and gray or color levels. Take a 256-level display as an example, the 256 levels are indicated by 8 bits, and as shown in the plot of FIG. 1, voltage values in the vertical axis respectively corresponding to gray/color levels 0~255 in the horizontal axis are selectively applied to the LCD pixels.

Generally, data are updated every frame in an LCD. Viewing from a single LCD pixel, transmittance readily varies with a given level data and an applied voltage. However, the response speed of liquid crystal is not definitely quick as well. Response speed is typically defined by a period of time required for achieving 10%~90% of expected luminance.

Generally, response speed significantly decreases in a low-temperature environment. A machine like a vehicular navigation system used in for example Northern Europe even possibly needs to be started in a temperature as low as minus tens of Centigrade degrees. In such a low temperature, liquid crystal is too viscous to be well responsive while starting. Therefore, the resulting image is vague and poor displaying quality is rendered.

A method having been developed for enhancing response speed of liquid crystal is known as "overdrive". An overdrive method is a technique applying a voltage higher than a voltage determined according to a given data level, e.g. 0~255, to accelerate the change of the LC state. The higher voltage, for example, is a voltage corresponding to a level higher than the given data level.

FIG. 2A and FIG. 2B schematically illustrate conventional overdrive methods. In the plots, the horizontal axis represents frame numbers, wherein each frame period is about 16.7 ms when driven under 60 Hz, and the vertical axis represents voltages respectively corresponding to gray/color levels. In an 256-level example, the level corresponding to black is defined as 0 and the level corresponding to white is defined as 255.

Referring to FIG. 2A, by general driving, the level of target 1 cannot be achieved until 10 frames or more pass. On the other hand, by overdriving with a voltage corresponding to a higher level OD1, the level of the target level 1 is achieved after 5 frames, as shown in the curve OD1. It is apparent that the response feature is improved. Therefore, it is feasible to reduce the time taken for achieving the target level 1 by applying an overdrive voltage OD1 during the first 5 frames and then applying a general drive voltage OD1' corresponding to the target level 1, as shown in FIG. 2B.

Likewise, as shown in FIG. 2A, if the target level 2 is to be achieved after 5 frames, a voltage corresponding to a higher level OD2 than the target level 2 is applied. In other words, a steeper curve OD2 is adopted in order to achieve the target level 2 after the same 5 frames. Afterwards, a general drive voltage OD2' corresponding to the target level 2 is applied, as shown in FIG. 2B. In this manner, the time taken for achieving the target level 2 can be reduced.

It is understood from the above that by way of overdriving, the states of liquid crystal molecules can be changed more quickly than by general driving so as to improve response property.

The overdrive method can be applied to achieve any desired target level, including the white level involving the steepest overdrive curve, after a predetermined number of frames, e.g. an arbitrary number more than 1.

Unfortunately, the conventional overdrive method is inefficient at a freezing low-temperature. For example, at −30° C., it requires about 100 frame periods to change from black to white. The overdrive operation for the first 5 frames shows almost no effect.

On the other hand, at a normal temperature, the same overdrive operation repetitively performed for a specified number of frames would deteriorate the following feature to previous images.

For precisely controlling overdrive voltages depending on images, another conventional overdrive method is proposed to predict level data for each pixel in the previous frame and then output overdriven level data accordingly, as disclosed in Japanese Patent Publication No. 2005-107531.

Since the overdrive operation in Japanese Patent Publication No. 2005-107531 is updated every frame, and it is known the level change between adjacent frames could be insignificant, the predicted values are likely to have no or almost no change. Then the overdrive effect cannot be seen.

SUMMARY OF THE INVENTION

Therefore, an object of the present invention is to provide an overdrive method, which is capable of enhancing response speed of an LCD even at a freezing low-temperature in which liquid crystal molecules are slowly responsive.

Another object of the present invention is to provide an LCD adopting an overdrive method for enhancing response speed.

According to a first aspect of the present invention, an overdrive method of a liquid crystal display (LCD) includes: using temperature-information-acquiring means to acquire temperature data near LCD elements which are arranged as a matrix; storing data-inputted target level values of an entire frame in a first frame memory; acquiring an overdrive value corresponding to the temperature data from a first data table established depending on temperature according to a combination of one of the target level values and a first predicted level value; acquiring a second predicted level value after a predetermined frame number corresponding to the temperature data from a second data table established depending on temperature according to a combination of the one of the target level values and the first predicted level value; storing the second predicted level values of an entire frame in a second frame memory; repetitively providing the same target level value from the first frame memory to the first data table and the second data table, and repetitively providing the same second predicted level value from the second frame memory to the first data table and the second data table as the first predicted level value, while accumulating a counted number of data input until the counted number reaches the predetermined frame number; and applying a driving voltage to a corresponding one of the LCD elements according to the overdrive value.

According to a second aspect of the present invention, a liquid crystal display (LCD) device includes LCD elements arranged as a matrix; temperature-information-acquiring means for outputting temperature data around the LCD elements; driving-voltage-supplying means for supplying driving voltages to the LCD elements according to respective levels; a first frame memory for storing input level values of an entire frame corresponding to the LCD elements, respectively; a first memory for previously storing an overdrive value varying with temperature in a table according to a combination of a target level value and an initial level value of one of the LCD elements; a second memory for previously storing a second predicted level value after a predetermined frame number depending on temperature in a table according to a combination of the target level value and the initial level value of the one of the LCD elements; a first lookup table acquiring a value from the first frame memory as the target level value according to the table acquired from the first memory depending on temperature, and using a first predicted level value as the initial level value to realize and output the overdrive value; a second lookup table acquiring a value from the first frame memory as the target level value according to the table acquired from the second memory depending on temperature, and using the first predicted level value as the initial level value to realize and output the second predicted level value; a second frame memory for storing the second predicted level values of an entire frame corresponding to the LCD elements, respectively, and realized from the second lookup table, wherein one of the second predicted level values is outputted to serve as the first predicted level value used in the first lookup table and the second lookup table; and a control device having the same level data repetitively transmitted from the first frame memory to the first lookup table and the second lookup table as the target level value before a period of the predetermined frame number is up, and having the second predicted level value repetitively transmitted from the second frame memory to the first lookup table and the second lookup table while having the overdrive value acquired form the first lookup table repetitively transmitted to the driving-voltage-supplying means during the period of the predetermined frame number.

According to a third aspect of the present invention, a liquid crystal display (LCD) device includes: LCD elements arranged as a matrix; temperature-information-acquiring means for outputting temperature data around the LCD elements; driving-voltage-supplying means for supplying driving voltages to the LCD elements according to respective levels; a first frame memory for storing input level values of an entire frame corresponding to the LCD elements, respectively; a memory storing a second level value after a predetermined frame number varying with temperature in a table depending on temperature and based on a combination of a target level value and an initial level value in an area where an overdrive value is constant, and storing an overdrive value in an area where a combination of a target level value and an initial level value are equal; a lookup table acquiring a value from the first frame memory as the target level value according to the table acquired from the memory depending on temperature, and using a first predicted level value as the initial level value to realize and output the overdrive value and the second level value; a second frame memory for storing the second predicted level values of an entire frame corresponding to the LCD elements, respectively, and realized from the lookup table, wherein one of the second predicted level values is outputted to serve as the first predicted level value used in the lookup table; and a control device having outputs from the first frame memory and the second frame memory repetitively transmitted to the lookup table according to an output of the temperature-information-acquiring means, while having the overdrive value acquired form the lookup table repetitively transmitted to the driving-voltage-supplying means during a period of the predetermined frame number.

In the overdrive method and the LCD according to the present invention, for example at a freezing low-temperature in which liquid crystal molecules are slowly responsive, the response speed of the device can still be enhanced by setting overdrive values in advance and utilizing predicted level values achieved after a predetermined number of frames at the temperature to perform an overdrive operation for the predetermined number of frames.

BRIEF DESCRIPTION OF THE DRAWINGS

The above contents of the present invention will become more readily apparent to those ordinarily skilled in the art after reviewing the following detailed description and accompanying drawings, in which.

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
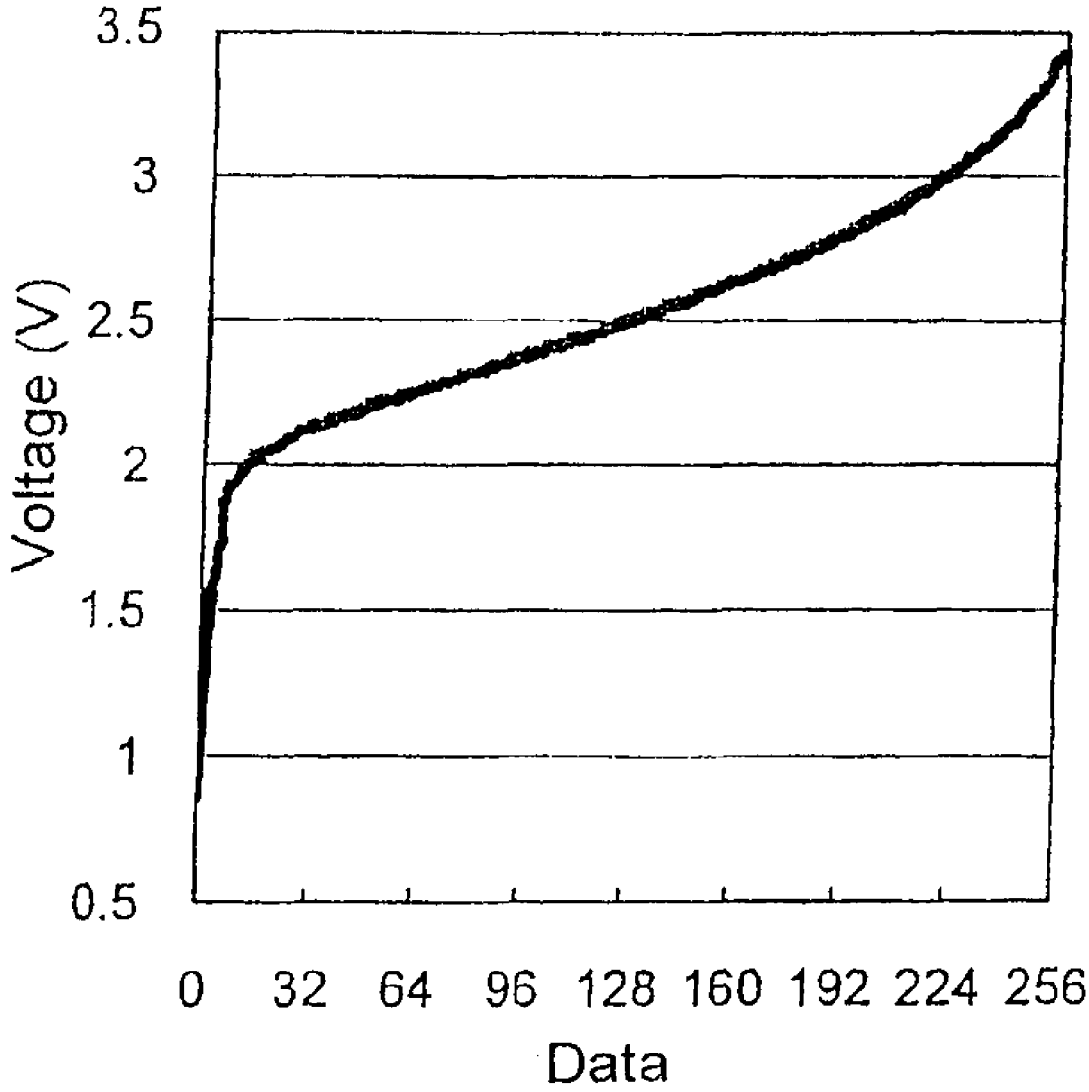
FIG. 1 PRIOR ART
FIG. 1 is a voltage vs. data plot of a conventional LCD.
Figure 2A:
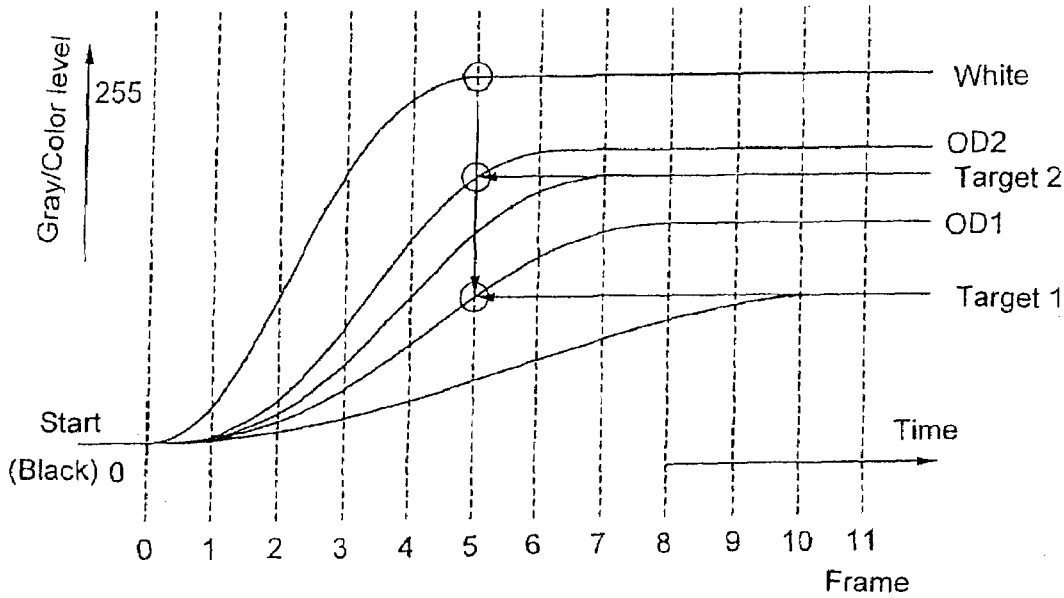
FIG. 2A PRIOR ART
FIG. 2A and FIG. 2B are schemes illustrating a conventional overdrive operation.
Figure 2B:
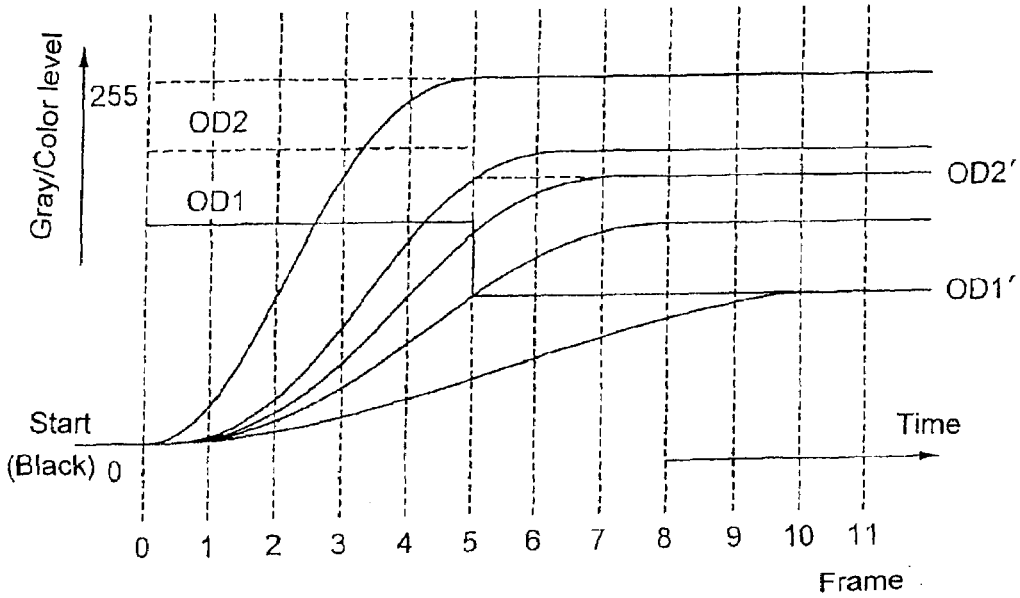
FIG. 2B PRIOR ART
Figure 3:
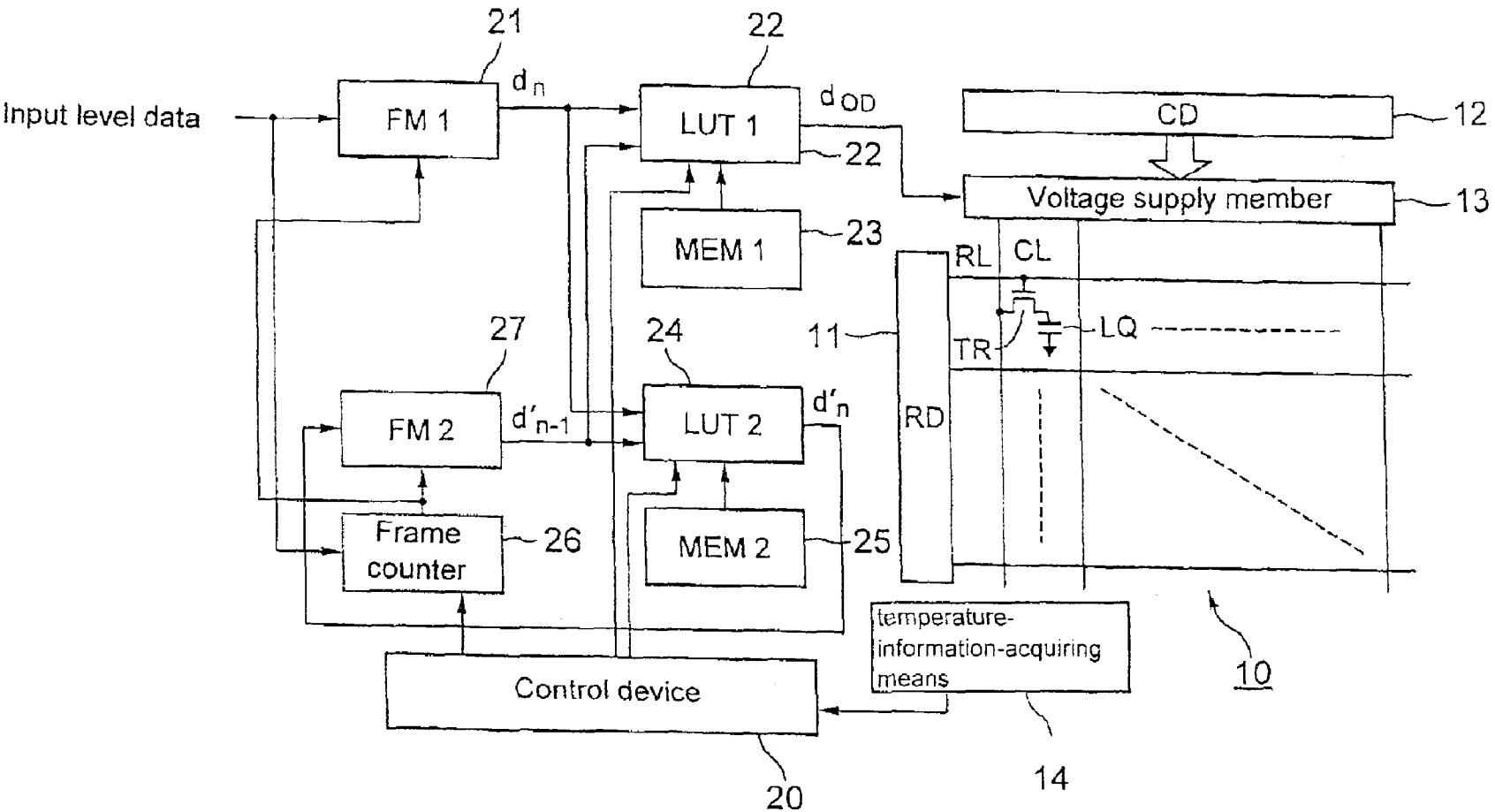
FIG. 3 is a functional block diagram of an LCD according to an embodiment of the present invention.

FIG. 3 illustrates driving means of an LCD according to an embodiment of the present invention.

Like a VGA frame which is composed of 640×480 pixels, liquid crystal elements LQ are allocated as a matrix and formed in an LCD panel. The LCD elements LQ are interconnected via transistors TR which have gates coupled to row lines RL selected by a row decoder 11 and sources coupled to column lines or data lines CL selected by a column decoder 12.

The row lines RL are enabled by the row decoder RD line by line. While the column decoder CD sequentially enables a column line CL, level data to be displayed is converted into a voltage value, and a voltage supply member 13 sequentially supplies the voltage corresponding to the expected level of the enabled column line CL to the selected LCD element so as to change transmittance of liquid crystal. For determining the ambient temperature in which the device is used, i.e. for acquiring the real temperature of the liquid crystal, temperature-information-acquiring means 14 is disposed on the LCD panel 10 for realizing temperature-associated information. The temperature information can be expressed by any proper temperature-dependent physical magnitude. For example, a thermo-sensor which directly shows temperature degrees is used as the temperature information acquiring means 14 in this embodiment.

In this embodiment, when necessary, the voltages finally applied to the LCD elements correspond to gray/color levels for overdriving.

Furthermore, there are two kinds of states selectively indicated when no voltage is supplied, i.e. normal black and normal white. In the example of LCD to be described hereinafter, it is normal black defined as level 0.

In this example, 60 frames are displayed per second, so it takes about 16.7 ms to input level data for each frame. The input level data includes all pixel data for an entire frame. For example, they include data of 640×480 pixels for a VGA frame. The input level data are stored in a first frame memory (FM1) 21 and outputted as target level values dn.

All the pixel data in the same row can be processed at one time or by time division. For easy illustration, a single pixel is processed at a time in this example.

A target level value dn outputted from the first frame memory 21 is inputted into a first lookup table (LUT1) 22 and a second lookup table (LUT2) 24. Each of the lookup tables has a size of 256×256.

The first lookup table 22 records therein optimal overdrive values respectively corresponding to combinations of initial level values in the vertical axis and target level values in the horizontal axis. The first lookup table 22 is coupled to a first memory (MEM1) 23 where optimal overdrive values previously determined by experiments under a variety of temperatures on the LCD panel and a variety of combinations of initial level values and target level values are stored as tables. The contents of the first lookup table 22 are updated with the contents of a table stored in the first memory 23 and corresponding to current temperature.

For example, assuming the initial level value is 0 (black), the target level value is 100, and the current temperature is room temperature, then a table corresponding to room temperature is used as the first lookup table 22. Since it is not necessary to take an overdrive action at room temperature, the output is exactly the target level value 100. On the other hand, at −30° C. where the level change of liquid crystal is relative slow, a table corresponding to −30° C. is used as the first lookup table 22 to output an experimentally maximum overdrive value, i.e. 255.

The second lookup table 24 stores therein predicted level values after a predetermined number of frames, wherein the combinations of the initial level values and the target level values are updated according to the predicted level values.

The use of such predicted level values makes the actual levels of liquid crystal reach the target values after a duration of one frame at a normal temperature. However, it takes a long time in practice to reach the expected level even if an overdrive operation is performed. The overdrive operation becomes ineffective. Since the levels almost do not change in each frame at an extremely low temperature, prediction cannot be well executed even if such predicted level values are used. Therefore, it requires a certain period of time waiting for significant level changes to see the overdrive effect.

The second lookup table 24 is coupled to a second memory (MEM2) 25. In the second memory 25, predicted level values previously determined under a variety of liquid-crystal temperatures and a variety of combinations of initial level values corresponding to temperature-dependent frame numbers and target level values received from the first frame memory 21 are stored. For example, the temperature-dependent repetitive frame number is 0 for temperature above −10° C., 1 for temperature between −10° C.~-20° C., i.e. outputting the same data twice, and 2 for temperature below −20° C., i.e. outputting the same data trice. Therefore, a table corresponding to current temperature is selected from the second memory 25 to update the second lookup table 24. Then predicted level values after a predetermined repetitive frame number are acquired according to combinations of target level values and initial level values and current temperature.

The predicted level values after the predetermined repetitive frame number under the current temperature are acquired from the second lookup table 24 and stored into a second frame buffer (FM2) 27 to realize predicted level values of all pixels for an entire frame.

A control device 20 for coordinating elements of the LCD receives a temperature-information signal from the temperature-information-acquiring means 14, and issues temperature-dependent instructions to the first and second frame memories 21 and 27 via a frame counter 26 as well as the first and second lookup tables 22 and 24.

The frame counter 26 detects input level data and starts counting in response to a starting position of each frame. Once the predetermined repetitive frame number corresponding to the input temperature information is counted up, the frame counter 26 issues an instruction to update the frame data stored in the first and second frame memories 21 and 27. For example, at −30° C., the preset repetitive frame number is 2, so the same data are outputted from the first and second frame memories 21 and 27 in response to the input level data until the counting value reaches 2, and updated data are outputted for next frame after the counting value reaches 2.

Currently predicted level values d'n−1 outputted from the second frame memory 27 are inputted to the first and second lookup tables 22 and 24. In other words, the second frame memory 27 retains currently predicted level values as initial level values of the first lookup table 22 and updated initial level values of the second lookup table 24 for next frame.

Figure 4:
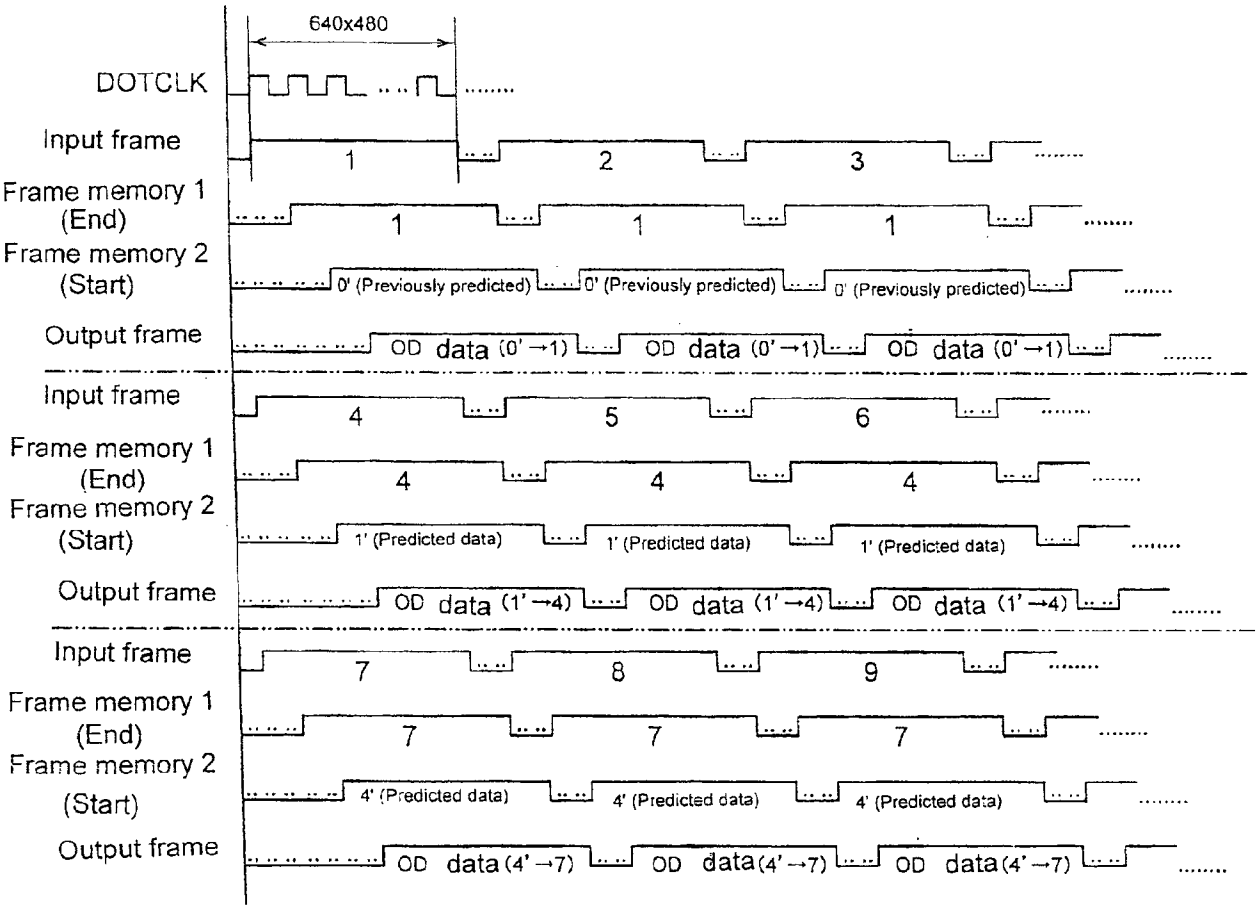
FIG. 4 is a timing-sequence diagram illustrating repetitive frame memory outputs according to an embodiment of the present invention.

FIG. 4 is a timing-sequence diagram exemplifying overdrive signal output of the LCD of FIG. 3, wherein the ambient temperature is −30° C. and the preset repetitive frame number is 3. The timing-sequence diagram shows 4 stages of timing sequences, each of which is divided into upper, middle and lower sections due to limitation of page space. The first stage shows input frame data including Frame 1 to Frame 9. The second stage shows the output from the first frame memory 21. It can be seen from FIG. 4 that the same data are outputted for every consecutive 3 frames. The third stage shows the output from the second frame memory 27 using a table established for −30° C., wherein in the first three frames, last predicted values are outputted for three frames. In this example, the target level value is achieved after 9 frames pass, wherein predicted level values relative to the first frame data are outputted for Frame 4 to Frame 6, and predicted level values relative to the fourth frame data are outputted for Frame 7 to Frame 9. The fourth stage shows overdrive output data determined according to the combinations of the outputs from the first frame memory 21 using a table established for −30° C. as the first lookup table 22 and the outputs from the second frame memory 27, wherein values respectively rising from the fourth frame and the seventh frame are used.

Figures 5, 6:
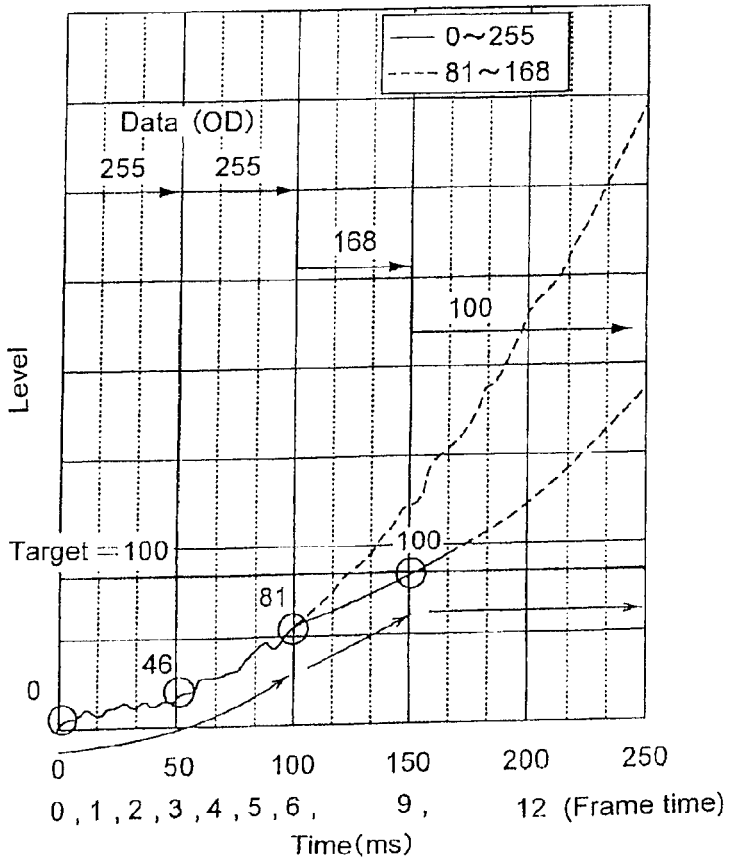
FIG. 5 is a table exemplifying the operation of FIG. 4.
FIG. 6 is a scheme illustrating the example of FIG. 5 by way of level variation.

Exemplified table and plot as shown in FIG. 5 and FIG. 6 are used to illustrate the overdrive operation according to the present invention in more detail. In this example, the ambient temperature is −30° C., the initial level value is 0, the target level value is 100, and the target level value does not change in 12 frames.

As the ambient temperature is −30° C., the same outputs from the first and second frame memories 21 and 27 last for three frames. In other words, frame data are sequentially outputted while the frame counter 26 accumulatively counts the frame number. Once the preset number 2 is counted up, the frame counter 26 issues an instruction to update contents of the frame memories 21 and 27.

In the example shown in FIG. 5, for the first three frames 0, 1 and 2, the overdrive value outputted from the first lookup table 22 is the maximal value 255. On the other hand, the predicted level value after three frames read from the second lookup table 24 is 46.

For next three frames 3, 4 and 5, the input value of the frame memory 27 becomes the predicted level value 46 of the previous three frames, which is used as the initial level value for the first lookup table 22 and updated initial level value for the second lookup table 24. From the first lookup table 22, an overdrive value 255 is acquired on the condition that the temperature is −30° C., the initial level value is 46 and the target level value is 100. Accordingly, from the second lookup table 24, a predicted level value 81 is acquired on the condition that the temperature is −30° C., the updated initial level value is 46, the target level value is 100 and the overdrive value is 255.

For further next three frames 6, 7 and 8, the initial level value rises to 81, so an overdrive value 168 is acquired from the first lookup table 22. Since it is experimentally realized that the overdrive value 255 used in last cycle results in overshooting the target level value, a lower value, e.g. 168, is recorded as the overdrive value.

By using the overdrive value, for frames 9, 10 and 11, the predicted level value after three frames acquired from the second lookup table 24 is consistent to the target level value 100 and outputted from the first lookup table 22.

FIG. 6 illustrates how the overdrive values and predicted level values change with frames indicated in the horizontal axis.

By maintaining the output level values from the frame memories for a predetermined number of frames, which is determined according to temperature, so as to significantly change the predicted level value, the overdriving effect can be maximized to accelerate displaying and enhance response even at an extremely low temperature.

Furthermore, buffer memories capable of storing 2 tables of data may be added between lookup tables and corresponding memories to facilitate smooth update of the lookup tables.

Hereinafter, another embodiment according to the present invention is illustrated, wherein the first lookup table 22 and the second lookup table 24 shown in FIG. 3 are combined.

Figure 7A:
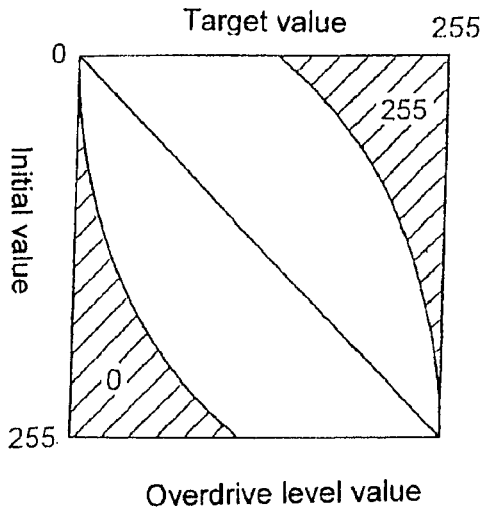
FIG. 7A is a scheme exemplifying the determination of an overdrive value according to an embodiment of the present invention.

As shown in FIG. 7A, with regards to the first lookup table 22, in order to light up the upper portion from the diagonal, a maximum level value 255 is used in many cases as the overdrive value for the hatching area where the target level value cannot be achieved after one frame. In contrast, for darkening, the darkest level value 0 in a specified range of the lower portion is used as the overdrive value.

Figure 7B:
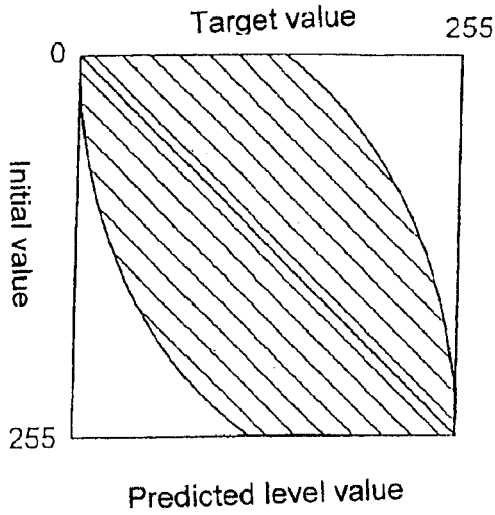
FIG. 7B is a scheme exemplifying the determination of a predicted level value according to an embodiment of the present invention.

On the other hand, as shown in FIG. 7B, with regards to the second lookup table 24, the predicted level value in the hatching portion near the diagonal is consistent to the target level value.

Figure 8:
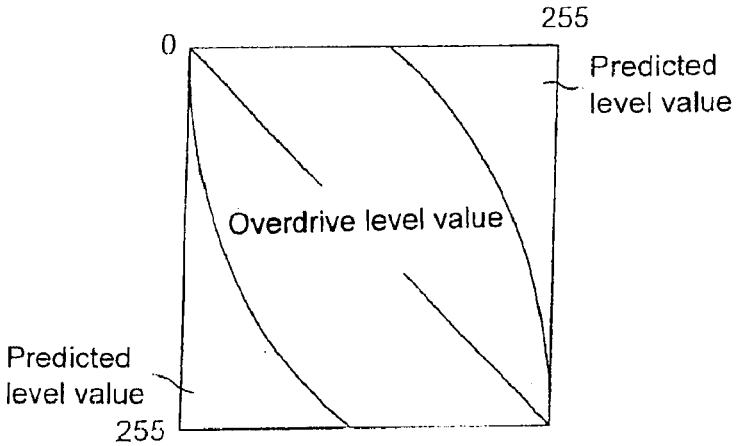
FIG. 8 is a scheme of data allocation in a single lookup table for acquiring both predicted level value and overdrive value according to another embodiment of the present invention.

Since these hatching portions are defined by single values, as shown in FIG. 8, the two lookup tables can be combined by recording overdrive values in the area near the diagonal (predicted level value=target level value) and recording predicted level values in the other area (overdrive value=0 or 255).

Figure 9:
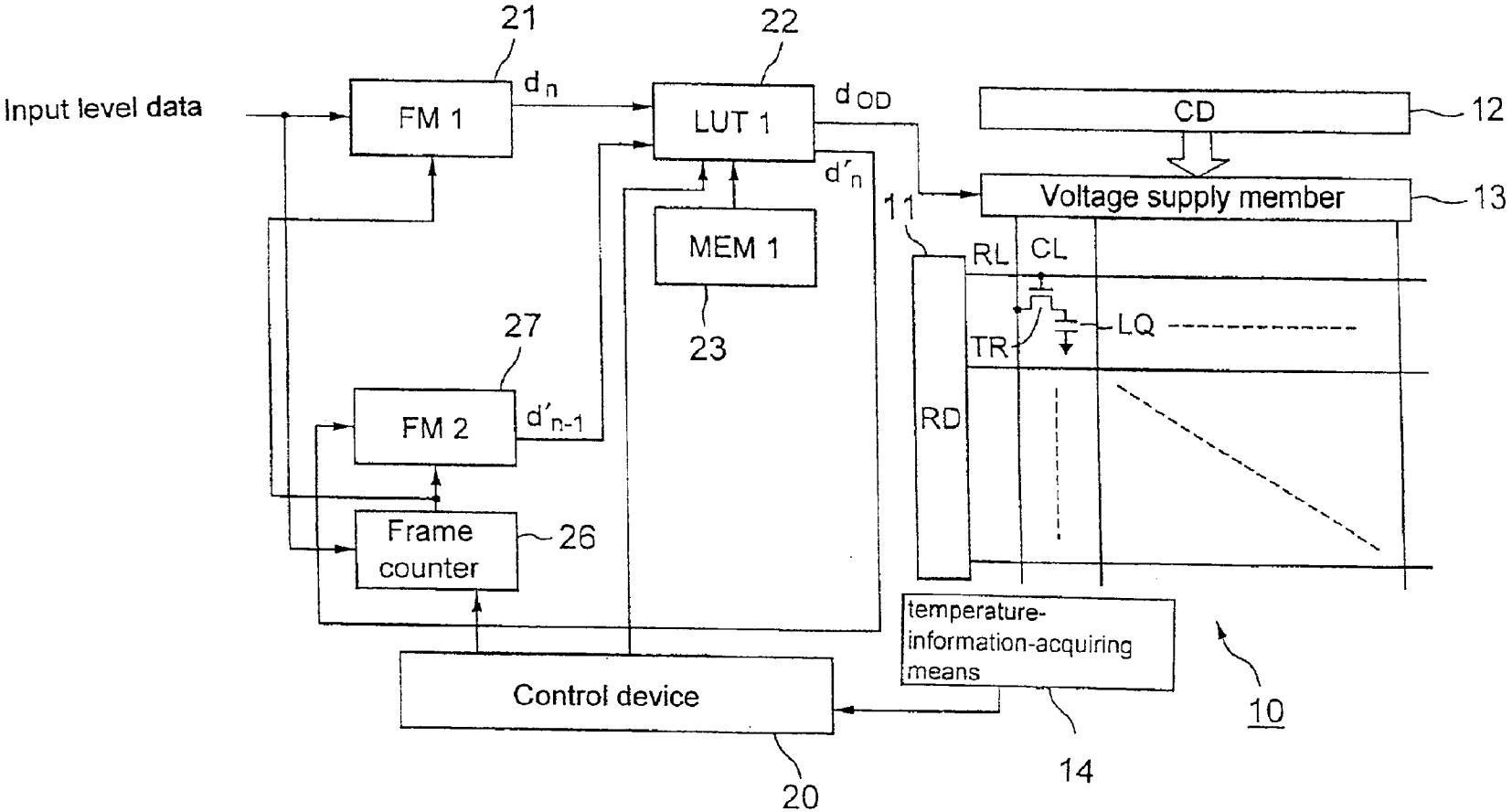
FIG. 9 is a functional block diagram of an LCD according to another embodiment of the present invention using the lookup table of FIG. 8.

The block diagram of the LCD according to this embodiment is illustrated in FIG. 9, in which the second lookup table 24 and the second memory 25 are omitted. The predicted value d'n outputted from the first lookup table 22 is inputted into the second frame memory.

This embodiment differs from the embodiment shown in FIG. 3 only in the operation that two values, i.e. a value acquired from FIG. 8 according to the initial level value and the target level value and a value required to be hidden, are used as the overdrive value and the predicted level value depending on area. The other parts are similar. Therefore, it is not to be redundantly described.

Furthermore, it is feasible to apply a voltage higher than the preset voltage corresponding to the level value 255 as the overdrive voltage.

Figure 10:
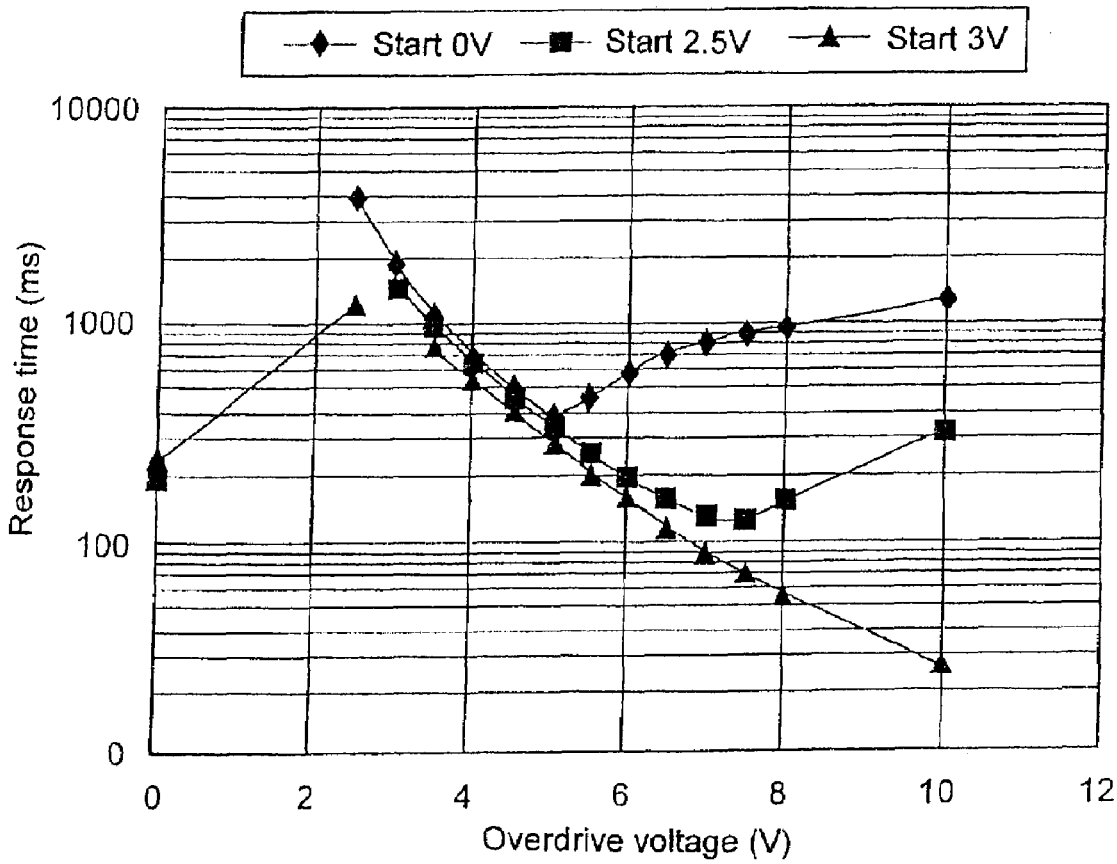
FIG. 10 is a response-time vs. overdrive-voltage plot showing the use of an extensive voltage beyond the preset voltage range as the overdrive voltage.

Please refer to FIG. 10. It can be seen that when the driving voltage is increased from the starting voltage 0V (black level) to an overdrive voltage 5V (white level), the response time is indeed shortened. However, the response speed slows down from then on. In the case that the starting voltage is 2.5V, the response time is also lengthened after the voltage exceeds 7V. One of the possible reasons is that the application of the high voltage before the orientations of liquid crystal molecules are defined would make the orientations of liquid crystal molecules inconsistent, and it takes time for accomplishing it. On the condition that the initial level value corresponds to 2.5V, however, the overdrive voltage may increase up to 7V (exceeding the voltage level of the while color).

It is also understood that on the condition that the initial level value corresponds to a starting voltage 3V, response time can be reduced by increasing the overdrive voltage up to 10V.

Therefore, by using a voltage range from a general black level voltage to a white level voltage before the voltage reaches the level corresponding to the initial level value and using a voltage range extending toward the high-voltage side compared to a general voltage range when the voltage is higher than the level corresponding to the initial level value, the response property can be further enhanced.

In other words, in the memory 23 of the embodiments shown in FIG. 3 and FIG. 9, the maximum value in the voltage range from a general black level voltage to a white level voltage is set as the maximal available overdrive value before the voltage corresponding to the initial level value reaches a predetermined level, while a voltage beyond the maximum value in the voltage range from the general black level voltage to the white level voltage is set as the maximal available overdrive value when the voltage corresponding to the initial level value exceeds the predetermined level.

It is to be noted that the above descriptions are only for illustrations of embodiments. Those skilled in the art may do general modifications and/or replacements for the embodiments, which are still covered in the scope of the present invention.

The above-described LCD according to the present invention can be applied to a variety of electronic apparatus such as mobile phones, digital cameras, personal digital assistants (PDAs), vehicular displays, aviatic displays, digital photo frames, portable DVD players, etc., particularly at a low temperature.

While the invention has been described in terms of what is presently considered to be the most practical and preferred embodiments, it is to be understood that the invention needs not to be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An overdrive method of a liquid crystal display (LCD), comprising:

using temperature-information-acquiring means to acquire temperature data near LCD elements which are arranged as a matrix;

storing data-inputted target level values of an entire frame in a first frame memory;

acquiring an overdrive value corresponding to the temperature data from a first data table established depending on temperature according to a combination of one of the target level values and a first predicted level value, wherein a maximum value in a driving voltage range from a black level voltage to a white level voltage is set as a maximal available overdrive value before a voltage corresponding to the initial level value reaches a predetermined level, and a voltage beyond the driving voltage range from the black level voltage to the white level voltage is set as the maximal available overdrive value when the voltage corresponding to the initial level value exceeds the predetermined level;

acquiring a second predicted level value after a predetermined frame number corresponding to the temperature data from a second data table established depending on temperature according to a combination of the one of the target level values and the first predicted level value;

storing the second predicted level values of an entire frame in a second frame memory;

repetitively providing the same target level value from the first frame memory to the first data table and the second data table, and repetitively providing the same second predicted level value from the second frame memory to the first data table and the second data table as the first predicted level value, while accumulating a counted number of data input until the counted number reaches the predetermined frame number; and applying a driving voltage to a corresponding one of the LCD elements according to the overdrive value.

2. The overdrive method of an LCD according to claim 1 wherein the predetermined frame number is set to a larger value when the temperature data shows the temperature is in a lower range.

3. A liquid crystal display (LCD) device, comprising:

LCD elements arranged as a matrix;

temperature-information-acquiring means for outputting temperature data around the LCD elements;

driving-voltage-supplying means for supplying driving voltages to the LCD elements according to respective levels;

a first frame memory for storing input level values of an entire frame corresponding to the LCD elements, respectively;

a first memory for previously storing an overdrive value varying with temperature in a table according to a combination of a target level value and an initial level value of one of the LCD elements, wherein in the first memory, a maximum value in a driving voltage range from a black level voltage to a white level voltage is set as a maximal available overdrive value before a voltage corresponding to the initial level value reaches a predetermined level, and a voltage beyond the driving voltage range from the black level voltage to the white level voltage is set as the maximal available overdrive value when the voltage corresponding to the initial level value exceeds the predetermined level;

a second memory for previously storing a second predicted level value after a predetermined frame number depending on temperature in a table according to a combination of the target level value and the initial level value of the one of the LCD elements;

a first lookup table acquiring a value from the first frame memory as the target level value according to the table acquired from the first memory depending on temperature, and using a first predicted level value as the initial level value to realize and output the overdrive value;

a second lookup table acquiring a value from the first frame memory as the target level value according to the table acquired from the second memory depending on temperature, and using the first predicted level value as the initial level value to realize and output the second predicted level value;

a second frame memory for storing the second predicted level values of an entire frame corresponding to the LCD elements, respectively, and realized from the second lookup table, wherein one of the second predicted level values is outputted to serve as the first predicted level value used in the first lookup table and the second lookup table; and a control device having the same level data repetitively transmitted from the first frame memory to the first lookup table and the second lookup table as the target level value before a period of the predetermined frame number is up, and having the second predicted level value repetitively transmitted from the second frame memory to the first lookup table and the second lookup table while having the overdrive value acquired from the first lookup table repetitively transmitted to the driving-voltage-supplying means during the period of the predetermined frame number.

4. The LCD according to claim 3, further comprising a frame counter accumulating a counted value in response to each update of the input level data, and having the repetitive output of the first frame memory and the second frame memory suspended while having the stored contents updated when the counted number reaches a preset value, wherein the preset value is increased when the temperature-information-acquiring means shows the temperature data is a low temperature.

5. The LCD according to claim 3 wherein in the first memory, a maximum value in a driving voltage range from a black level voltage to a white level voltage is set as a maximal available overdrive value.

6. The LCD according to claim 3 wherein in the first memory, a voltage beyond a driving voltage range from a black level voltage to a white level voltage is set as a maximal available overdrive value.

* * * * *